US005465949A

United States Patent [19]

Yamada et al.

[11] Patent Number: 5,465,949

[45] Date of Patent: Nov. 14, 1995

[54] AUTOMATIC SHEET FEEDING DEVICE WITH SELECTIVELY APPLIED PRESSURE MEMBER

[75] Inventors: Takeshi Yamada, Sagamihara; Katsuaki Hirai, Yokohama, both of Japan

[73] Assignee: Canon Kabushiki Kaisha, Tokyo, Japan

[21] Appl. No.: 412,105

[22] Filed: Mar. 28, 1995

Related U.S. Application Data

[63] Continuation of Ser. No. 260,836, Jun. 16, 1994, abandoned.

[30] Foreign Application Priority Data

Jun. 24, 1993 [JP] Japan ..... 5-177281

[51] Int. Cl.[6] ..... B65H 7/08

[52] U.S. Cl. ..... 271/110; 271/122; 271/126; 271/258.03; 271/3.13

[58] Field of Search ..... 271/110, 111, 271/122, 126, 3.1, 258, 121, 10

[56] References Cited

U.S. PATENT DOCUMENTS

| | | | |
|---|---|---|---|
| 4,085,929 | 4/1978 | Tuchiya et al. | 271/122 |
| 4,925,177 | 5/1990 | Nakamura et al. | 271/110 |
| 5,197,629 | 3/1993 | Sanchez | 271/126 |
| 5,201,508 | 4/1993 | Kuo | 271/10 |
| 5,219,156 | 6/1993 | Mori | 271/122 |
| 5,295,675 | 3/1994 | Hain | 271/126 |

FOREIGN PATENT DOCUMENTS

| | | | |
|---|---|---|---|
| 5254675 | 10/1993 | Japan | 271/110 |

*Primary Examiner*—H. Grant Skaggs
*Attorney, Agent, or Firm*—Fitzpatrick, Cella, Harper & Scinto

[57] ABSTRACT

An automatic sheet feeding device includes a mounting unit for mounting a stack of sheets, a feeder for feeding each sheet of the stack of sheets, and a pressing unit for pressing the stack of sheets against the feeder by operating on the stack of sheets whenever necessary after feeding a sheet, a recording unit for recording the number of operations of the pressing unit, and a controller for causing the pressing unit to operate when a sheet feeding operation of the feeder starts after the number of operations of the pressing unit has reached a predetermined number.

20 Claims, 4 Drawing Sheets

AUTOMATIC SHEET FEEDING DEVICE WITH SELECTIVELY APPLIED PRESSURE MEMBER

This application is a continuation of application Ser. No. 08/260,836, filed Jun. 16, 1994, now abandoned.

BACKGROUND OF THE INVENTION

1. Field of the Invention

This invention relates to an automatic sheet feeding device, and more particularly, to a sheet-material feeding device for feeding a sheet material to a predetermined position such as an image reading position or the like, for use in an image forming apparatus, such as a copier, a laser-beam printer, or the like.

2. Description of the Related Art

A conventional automatic sheet feeding device is provided at an upper portion of an image forming apparatus. The original sheets are mounted on a sheet mount and then sequentially fed from the lowermost sheet of the stack by a feeding roller. Thereafter, each fed sheet is detected by a sheet detector provided downstream of the feeding roller. When the fed sheet does not reach the sheet detector within a predetermined time period, the lowermost sheet is pressed against the feeding roller by operation of a sheet pressing member (also called a weight), whereby the feeding force of the feeding roller is increased to assist in the sheet feeding operation.

In the above-described conventional device, each time a failure is detected during the feeding operation of an original sheet from among the original stack, a sheet feeding operation is performed by operating the sheet pressing member after the lapse of a predetermined period of time. Hence, the time required for feeding the entire stack of originals to an image reading position on the image forming apparatus increases, thereby greatly increasing the processing time of the image forming apparatus.

SUMMARY OF THE INVENTION

The present invention has been made in consideration of the above-described problems.

It is an object of the present invention to provide an automatic sheet feeding device which can perform high-speed processing.

It is another object of the present invention to reduce the sheet processing time of an apparatus by controlling a pressing operation of a sheet pressing member in accordance with the number of operations of the sheet pressing member detected during one cycle of feeding a stack of sheets.

According to one aspect, the present invention which achieves these objectives relates to an automatic sheet feeding device including mounting means for mounting a stack of sheets, feeding means for feeding each sheet of the stack of sheets, a pressing means for pressing against the stack of sheets by urging the stack of sheets against the feeding, recording means for recording the number of operations of the pressing means, and control means for causing the pressing means to operate when a sheet feeding operation of the feeding means starts after the number of operations of the pressing means has reached a predetermined number.

In one embodiment, the device further comprises setting means for presetting the number of operations of the pressing means during one cycle of feeding the stack of sheets, and setting changing means for changing the number of operations of the pressing means set by the setting means.

According to the above-described configuration, the number of operations of the sheet pressing means during one cycle of feeding the entire stack of sheets is recorded by the recording means. When the number of the operations has reached a preset number, the sheet pressing means is operated when the feeding operation of the next sheet is started, so that the processing time of the device does not delay more than a predetermined time period.

The preset number of operations of the sheet pressing means can be changed by the setting changing means. It is thereby possible to delay the start of a continuous operation of the sheet pressing means, so that the user will not be annoyed by the operation of the sheet pressing means.

DESCRIPTION OF THE PREFERRED EMBODIMENTS

First Embodiment

A description will now be provided of a first embodiment of the present invention with reference to the drawings.

Figure 1:
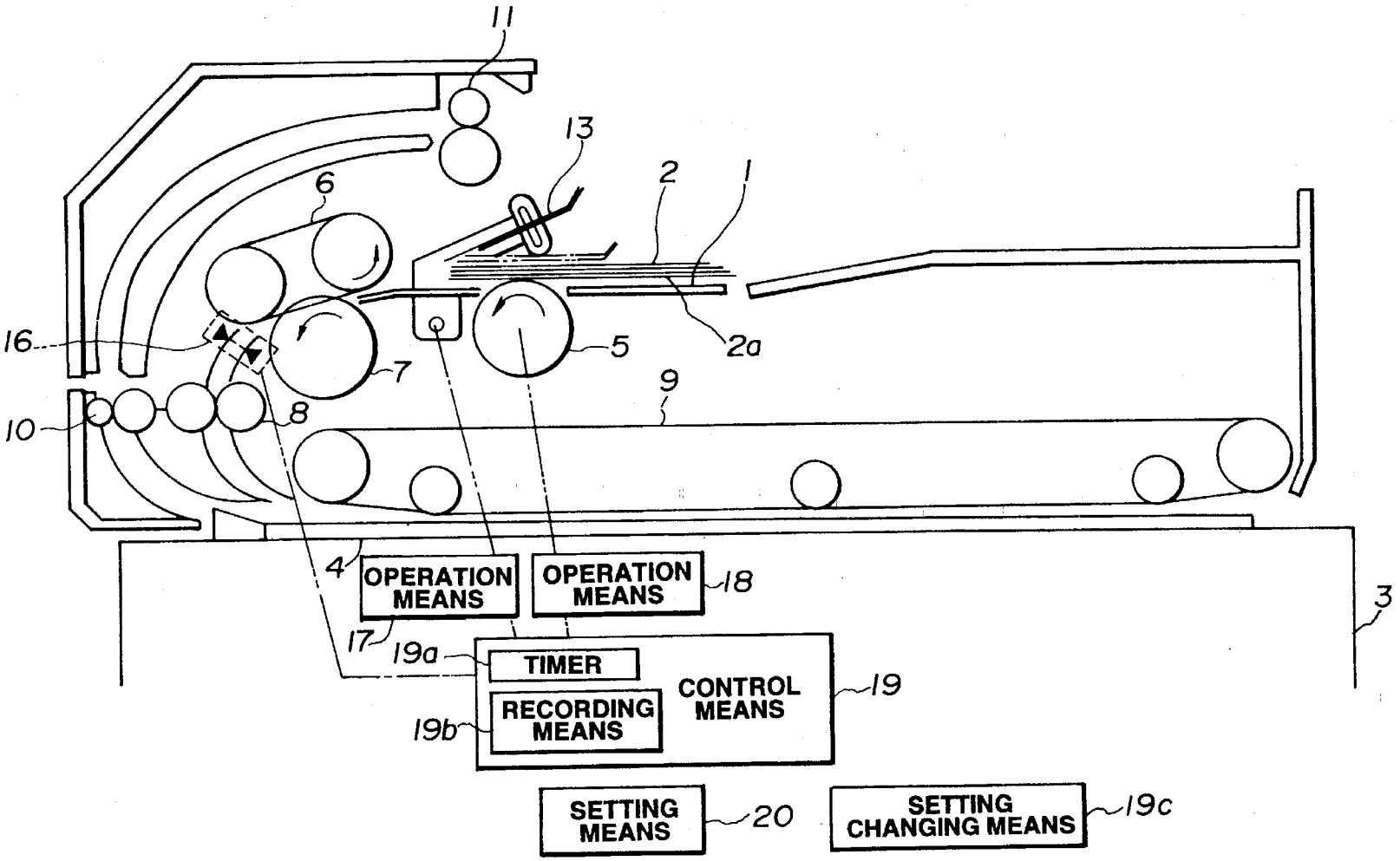
FIG. 1 is a cross-sectional view, as seen from the front, of an automatic sheet feeding device according to a first embodiment of the present invention.
Figure 2:
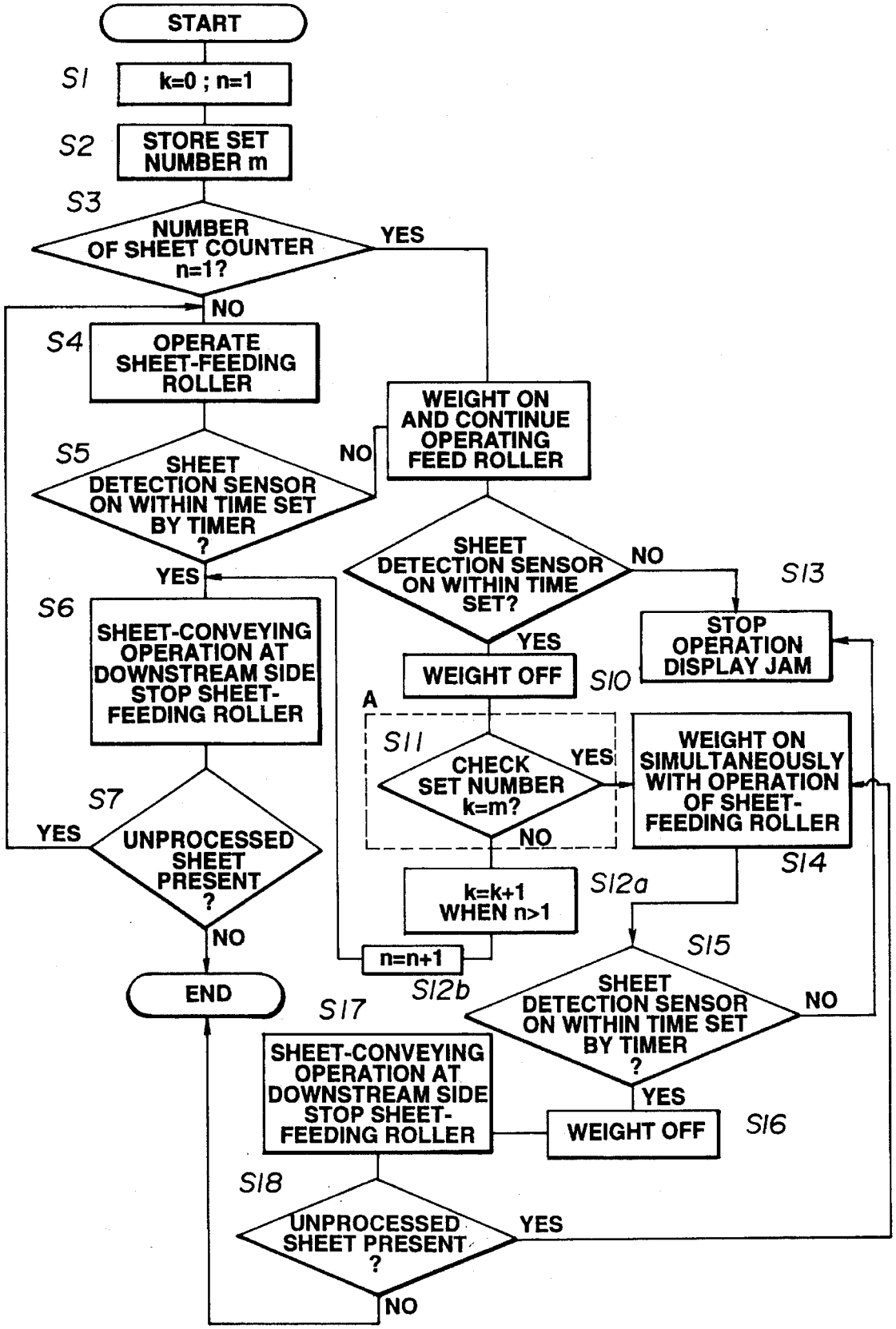
FIG. 2 is a flowchart illustrating the operation of the automatic sheet feeding device shown in FIG. 1.

FIG. 1 illustrates an automatic sheet feeding device according to the first embodiment. FIG. 2 is a flowchart illustrating the operation of control means 19 shown in FIG. 1.

In FIG. 1, the automatic sheet feeding device, disposed on a main body 3 of an image forming apparatus, includes sheet mount (mounting means) 1 for mounting a bundle of original sheets 2, a feeding roller (feeding means) 5 for feeding the lowermost sheet 2*a* of the bundle of original sheets 2, a pressing member 13 for pressing the upper portion of the bundle of original sheets 2 to increase the feeding force of the feeding roller 5.

A separation portion comprising a feeding roller 7 and a separation belt 6, a sheet detection sensor (sheet detection means) 16 for detecting the fed sheet 2*a*, and registration rollers 8 are sequentially disposed downstream of the pressing member 13. The sheet 2*a* fed by the registration rollers 8 is conveyed by a conveying belt 9 onto a glass platen 4 of the main body 3 of the image forming apparatus, and an image on the sheet is read. After image reading sheet 2*a* is fed by the reverse rotation of the belt 9 to conveying rollers 10, and is discharged onto the sheet mount 1 by conveying rollers 10 and discharging rollers 11.

The feeding roller 5 is rotated by operation means 18, such as a motor, which is controlled by control means 19. The pressing member 13 is operated by operation means 17, such as a plunger, also controlled by the control means 19. The control means includes a timer 19*a*, recording means (a counter) 19*b*, and setting changing means 19*c*. The user presets the number of operations of the pressing member 13 during one cycle of feeding the stack of sheets 2 by operating setting means 20.

The timer 19*a* times from the start of the feeding of the sheet 2*a* (either from when a sheet-feeding signal is 10 generated, or from when the roller 5 starts to rotate) until the leading end of the sheet 2*a* is detected by the sheet detection sensor 16. The recording means 19*b* records (counts) the number of operations of the pressing member 13 during one cycle of feeding of the entire stack of sheets 2. Setting changing means 19*c* is used by the operator to change the number of operations of the pressing member 13 preset by the setting means 20 during the feeding cycle.

Next, a description will be provided of the operation of the automatic sheet feeding device.

Before feeding the stack of sheets 2, variable k, which stores the number of operations of the pressing member 13 during one cycle of feeding the stack of sheets 2, is set to zero, and n, which identifies when the original is the first original fed during one cycle, is set to 1. Variable m is then set by the operator by operating the setting means 20 (step S2). M is set to equal the number of sheet feeding failures that need to occur following which pressing member 13 will operate for every remaining feed of sheets from the stack.

When the user has depressed an operation start button (not shown) on the main body 3 of the image forming apparatus after mounting the stack of sheets 2 on the sheet mount 1, a determination is made as to whether n=1, and, if so, it is concluded that the first sheet is being fed (step S3). If n=1, the pressing member 13 is lowered to a sheet-pressing position in order to assist the sheet-feeding operation, and the feeding roller 5 continues to be rotated in the sheet-feeding direction by operation means 18 under control of the control means 19 at the same time, whereby the lowermost sheet 2*a* of the stack of sheets 2 is fed (step S8). Next, a determination is made whether the leading end of the sheet separated by the separation portion is detected by the sheet detection sensor 18 within a predetermined time, and a signal from the sheet detection sensor 18 is transmitted to the control means 19 to indicate passage of the sheet by sensor 18 within a predetermined time period (step S9). If not, the operation stops and an indication of a jam is displayed (step S13).

If in step S9 the sheet has passed sensor 16 within a predetermined period of time, the control means 19 releases the pressure of the pressing member 13 (step S10), and controls the introduction of the original to the platen 4 on the main body 3 of the image forming apparatus and the discharge of the original from platen 4 on the main body 3 of the image forming apparatus by controlling the registration rollers 8 and the conveying belt 9, both serving as sheet-conveying means, and both provided at a side downstream from the separation portion. Variable k, which is still set at zero, is compared to set number m, and since it is not equal to m, the process continues to step S12*a*. Since the first sheet is being fed, n still equals 1, and therefore k is not incremented (step S12*a*) and the process returns to step S8. However, before returning to step S6, n is incremented by one (step S12*b*).

In feeding operations of second and subsequent sheets, the sheet feeding roller is operated (step S4) initially without the weight being applied by pressing member 13. A determination is then made as to whether a sheet-feeding operation failure has occurred based on a failure of the sheet to reach the sheet detection sensor 16 within a predetermined time period after the start of the sheet-feeding operation (step S5). If no failure is detected, the pressing member 13 does not press against the sheet, and the sheet feeding device continues the sheet-feeding operation downstream of sensor 16 without use of the pressing member (step S6) until all of the sheets have been processed (steps S4 to S7).

If a failure in a sheet-feeding operation occurs while the n-th sheet is fed (for the second and subsequent sheets where n>1), the n-th sheet will not reach the sheet detection sensor 16 after the lapse of a predetermined time period after starting the feeding operation of the n-th sheet (step S5). At that time, the pressing member 13 moves to the sheet-pressing position to assist the feeding operation of the sheet which continues to operate (step S8).

If the sheet does not reach the sheet detection sensor 16 within a predetermined time period even after the above-described operation of the pressing member 13 (step S9), the sheet feeding device interrupts the operation assuming that a jam has occurred at the sheet-feeding portion (step S13). However, when the sheet has reached the sheet detection sensor 16 within the predetermined time period, the pressing member 13 is released (step S10). At this time the number of operations k of the pressing member 13 caused by failures in sheet-feeding operations is compared to stored set number m (step S11) and if k is not equal to m, k is incremented by 1 in the counting means 19*b* within the sheet feeding device, provided that n>1; namely, provided that this is not the first sheet where the pressing member is applied without regard to detection of a feed failure (step S12*a*). N is then incremented by 1 (step S12*b*) and the process returns to step S6.

Thereafter, the sheet feed roller 5 stops and sheet conveying rollers downstream of sensors 16 operate (step S6). The sheet feeding operations are continued in the sequence of the (n+1)-th sheet, the (n+2)-th sheet, . . . , and the number of operations k of the pressing member 13 caused by the failures in sheet feeding operations occurred during one cycle of feeding the bundle of sheets is counted in the counting means 19*b*.

If a determination is made in step S11 that the recorded number k of pressing member operations caused by sheet feed failures has equaled the preset number m, the next sheet feeding operation is started, and the pressing member 13 operates simultaneously with the start of the operation of the feeding roller 5 to assist the sheet feeding operation (step 14). Next, a determination is made whether the sheet has reached the sheet detection sensor 16 within the predetermined time (step S15). If not, a jam is assumed and the operation stops (step S13). If so, the pressing member 13 returns to a position where the pressure is released (step S16). Thereafter, the feed roller stops and the sheet is conveyed downstream of sensor 16 (step S17). If unprocessed sheets remain (step S18), the above-described processing (pressing and releasing) is repeated until the feeding of all the sheets is completed (steps S14–S18). If no sheets remain, the process ends.

The above-described expression "simultaneously with the start of the operation" should not be strictly interpreted, but may include a case of operating within a desired time period.

If the preset number m equals 1, the automatic sheet feeding device operates in the following manner. That is, if the pressing member 13 operates as a result of a failure in 10 a sheet feeding operation, the pressing member 13 thereafter operates for each sheet until sheet feeding operations are completed. Hence, the sound generated by the pressing member 13 in operation is frequently heard. If the set number m can be changed such that m≧2, the processing time of the image processing apparatus more or less increases, but the frequency of the generation of the sound of the pressing member 13 in operation can be reduced.

By executing the above-described operations, it is possible to limit a delay in feeding of sheets to a time period corresponding to a preset number of sheets, and to prevent a great increase in the processing time of the image forming apparatus.

Second Embodiment

In the above-described first embodiment, when the number of failures in sheet feeding operations reaches a preset number at an initial stage of one cycle of feeding sheets, the pressing roller 13 thereafter operates for each sheet. Hence, the sound generated by the pressing member 13 in operation may, in some cases, annoy the operator.

Figure 3:
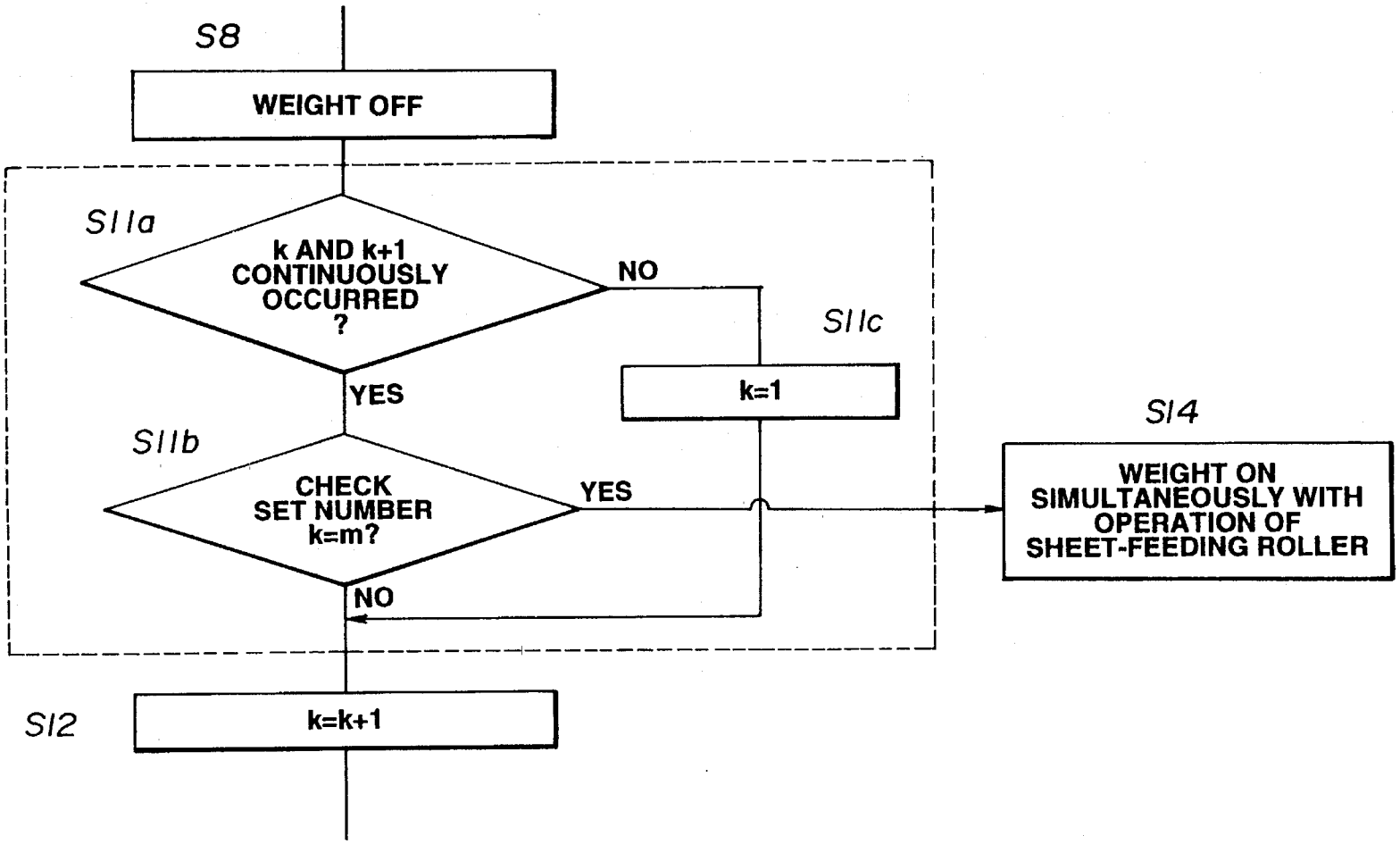
FIG. 3 is a flowchart illustrating the operation of a second embodiment of the present invention.

In order to solve such a problem, in a second embodiment of the present invention, "portion A" shown in FIG. 2 is replaced by "portion A" shown in FIG. 3. In this approach, it is determined whether the pressing member 13 is consecutively operated because of failures in sheet feeding operations. Only when the number of the consecutive operations of the pressing member 13 reaches the set number m, the pressing member 13 is consecutively operated simultaneously with the start of the sheet feeding operation.

When failures in sheet feeding operations intermittently occur, or when failures in sheet feeding operations consecutively occur but the number of failures does not reach the set number m, the set number m may be initialized and set to "1". Thus, it is possible to reduce the number of the occurrence of consecutive operations of the pressing member 13 without reducing the processing speed of the image processing apparatus, and to reduce annoyance caused by the sound generated by the pressing member 13 in operation.

If the set number m can be changed such that $m \geqq 3$, the processing time of the image processing apparatus more or less increases, and the annoyance caused by the sound generated by the pressing member 13 in operation is further reduced.

In order to know the number of the operations of the pressing member 13, the number may be counted one by one, or the operation times may be accumulated until a detector detects that the accumulated time reaches a predetermined number of seconds. Counting or detecting methods used in any of the above-described approaches will be termed recording means. In the latter case, since the time required for one operation is previously known, the number of the operations can also be counted by knowing the accumulated seconds.

The feeding roller 5 may have not only the function of a preliminary roller (for feeding a plurality of sheets), but also the function of a separation roller. In such a case, the rollers 6 and 7 are omitted, and individual-sheet separation means (means for forming a gap for individually separating sheets) is provided in the vicinity of the roller 5.

The sheets may not be pressed from above and separated from below. The present invention may also be applied to a case in which the sheets are pressed from below and separated from above. When pressing the sheets from below, the sheets may be previously pressed with a constant force, and an additional force (released every time a sheet is fed) may be added whenever necessary.

Figure 4:
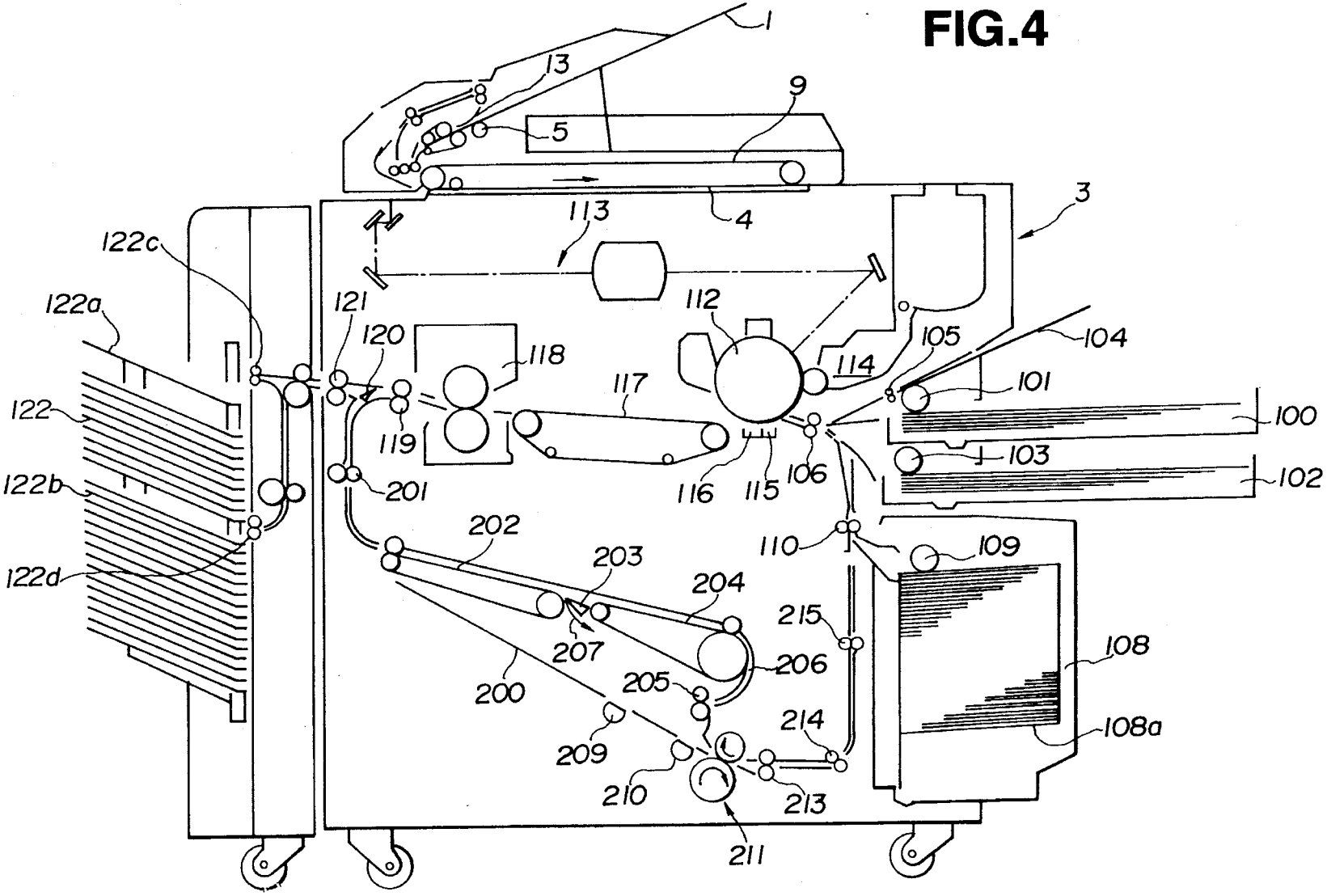
FIG. 4 is a cross-sectional view, as seen from the front, illustrating the entire configuration of an image forming apparatus to which the automatic sheet feeding device of the present invention is applied.

Next, a description will be provided of the entire configuration of the image forming apparatus (the sheet feeding device, the main body 3 of the image forming apparatus, and a sorter 122) with reference to FIG. 4.

In FIG. 4, sheets within an upper cassette 100 are individually separated and fed by separation pawls and a feeding roller 101, and each separated sheet is guided to registration rollers 106. Sheets within a lower cassette 102 are individually separated and fed by separation pawls and a feeding roller 103, and each separated sheet is guided to the registration rollers 106. Each sheet inserted from a manual insertion guide 104 is fed to the registration rollers 106 via rollers 108. A deck type sheet mounting device 108 includes an intermediate plate 108a vertically moved by a motor, or the like (not shown). Sheets on the intermediate plate 108a are individually separated and fed by separation pawls and a feeding roller 109, and each separated sheet is guided to conveying rollers 110.

There are also shown a photosensitive drum 112, a reading optical system 113, a developing unit 114, a transfer charger 115, and a separation charger 116. These units constitute an image forming unit.

A conveying belt 117 conveys a sheet on which an image has been formed. There are also shown a fixing unit 118, conveying rollers 119, and a flapper 120. The sheet on which the image has been formed is guided to discharging rollers 121 by the flapper 120, and is conveyed into the sorter 122. The sorter 122 includes non-sorting trays 122*a*, sorting bin trays 122*b*, discharging rollers 122*c* for the non-sorting trays, and discharging rollers 122*d* for the sorting bin trays. The non-sorting trays 122*a* and the sorting bin trays 122*b* vertically move to sort sheets on respective trays. A discharging tray is, in some cases, mounted instead of the sorter 122. 10 An image on a sheet of the original placed on the platen 4 is formed on the photosensitive drum 112 a number of times corresponding to the set number of copies. Every time the image is formed on the photosensitive drum 112, a sheet is supplied from any of the cassettes 100 and 102 and the deck 108. The supplied sheet is aligned with the image on the photosensitive drum 112 by the registration rollers 106.

When copies of the required number have been formed, the original is discharged from the platen 4, and the next original is positioned on the platen 4. The above-described processing is thereafter repeated.

When forming images on both surfaces of each sheet, or when superposing (multiplexing) plural images on one surface of each sheet, an intermediate tray 200 stacks each sheet on which an image has been formed. There are also shown conveying rollers 201, a conveying belt 202, a flapper 203, a conveying belt 204, and conveying rollers 205. When obtaining duplex copies, each sheet is guided to the intermediate tray 200 via a path 206, and the surface of each sheet having an image is placed upward. When obtaining multiplex copies, each sheet is guided to the intermediate tray 200 via a path 207, and the surface of each sheet having an image is placed downward.

The sheets mounted on the intermediate tray 200 are individually separated and refed from the bottom sheet by auxiliary rollers 209 and 210, and a pair of forwardly and reversely rotating separation rollers 211. Each refed sheet is guided to the image forming unit via conveying rollers 213, 214 and 215, the rollers 110 and the registration rollers 106. After image formation, the sheet is discharged by discharge rollers 121 in the above-described manner.

First, single-sided copies are obtained in accordance with the set number of copies from one surface of an original placed on the platen 4, and are mounted in the intermediate tray 200. Thereafter, the original is turned over, and is placed again on the platen 4. The image on the other surface of the original is read a number of times corresponding to the set number of copies. The read image is formed on a sheet refed from the intermediate tray 200 for each reading operation. The sheet on which the image has been formed is classified by the sorter 122 according to the corresponding page.

In another approach, only a set of copies is formed at every cycle of sheets of the original. According to this approach, even when forming a plurality of sets of copies, respective sets of copies arranged in the sequence of pages can be sequentially obtained. Hence, classified copies of a required number can be separately obtained without using the sorter. When forming duplex copies by this approach, images on both surfaces of the original are consecutively read and copied on both surfaces of a copy sheet, and the copy sheet is discharged. A group of classified duplex copies can be obtained by repeating the same processing for other sheets of the original.

The individual components shown in outline or designated by blocks in the drawings are all well known in the automatic sheet feeding device arts and their specific construction and operation are not critical to the operation or best mode for carrying out the invention.

While the present invention has been described with respect to what is presently considered to be the preferred embodiments, it is to be understood that the invention is not limited to the disclosed embodiments. To the contrary, the present invention is intended to cover various modifications and equivalent arrangements included within the spirit and scope of the appended claims.

What is claimed is:

1. An automatic sheet feeding device, comprising:

mounting means for mounting a stack of sheets; feeding means for feeding each sheet of the stack of sheets from the stack;

pressing means for pressing against the stack of sheets after a start of a sheet feeding operation, thereby urging the stack of sheets against said feeding means;

recording means for recording a number of operations of said pressing means; and control means for controlling operation of said pressing means, wherein said pressing means operates when a sheet feeding operation of the feeding means starts after the number of operations of the pressing means recorded by said recording means has reached a predetermined number.

2. A device according to claim 1, further comprising:

setting means for presetting the predetermined number of operations of the pressing means; and setting changing means for changing the predetermined number of operations of the pressing means set by the setting means.

3. A device according to claim 1, wherein said recording means records the number of operations of said pressing means by counting the number of sheets for which said pressing means has operated.

4. A device according to claim 1, further comprising means for determining if the number of operations of said pressing means counted by said recording means have been counted consecutively, wherein when the number of operations has been counted consecutively, said pressing means is thereafter operated when the feeding means starts the feeding operation.

5. A device according to claim 1, wherein said feeding means feeds the lowermost sheet of the stack of sheets, and wherein said pressing means presses against the uppermost sheet of the stack of sheets.

6. A device according to claim 1, further comprising separation feed means for separating and feeding each sheet downstream of the feeding means, and wherein said feeding means simultaneously feeds a plurality of sheets.

7. A device according to claim 1, wherein said feeding means feeds each sheet of the stack of sheets while individually separating the sheets.

8. A device according to claim 1, further comprising:

sheet detection means for detecting the fed sheet at a predetermined position at a side downstream from the feeding means;

a timer for counting the time from the start of the sheet feeding operation until the sheet reaches said sheet detection means; and operation means for pressing the bundle of sheets by causing the pressing means to operate when the fed sheet has not reached the sheet detection means within a predetermined time period after the start of the sheet feeding operation, to assist the sheet feeding force of the feeding means.

9. An automatic sheet feeding device, comprising:

mounting means for mounting a stack of sheets;

feeding means for feeding each sheet of the stack of sheets from the stack;

pressing means for pressing against the stack of sheets after a start of a sheet feeding operation, thereby urging the stack of sheets against said feeding means;

recording means for recording a number of operations of the pressing means, said recording means recording the number of operations of said pressing means by accumulating operating time of said pressing means; and control means fop controlling operation of said pressing means, wherein said pressing means operates when a sheet feeding operation of the feeding means starts after the number of operations of the pressing means recorded by said recording means has reached a predetermined number.

10. An automatic sheet feeding device, comprising:

mounting means for mounting a stack of sheets;

feeding means for feeding each sheet of the stack of sheets from the stack;

detection means for detecting a feeding error;

pressing means for pressing against the stack of sheets when the feeding error is detected by said detection means, thereby urging the stack of sheets against said feeding means;

counting means for counting a number of operations of said pressing means; and control means for controlling operation of said pressing means, wherein said control means causes said pressing means to press against the stack when said feeding means operates, without regard to detection of the feeding error, whenever the number of operations of the pressing means counted by said counting means has reached a predetermined number.

11. A device according to claim 10, wherein the feeding error is detected by said detection means when the sheet does not reach a predetermined position during a predetermined time period.

12. A device according to claim 11, wherein said detection means comprises a sheet detection sensor for detecting the fed sheet at a predetermined position downstream of the feeding means, and a timer for counting the time from the start of the sheet feeding operation until the sheet reaches said sheet detection sensor.

13. An automatic sheet feeding device, comprising:

mounting means for mounting a stack of sheets;

feeding means for feeding each sheet of the stack of sheets from the stack;

detection means for detecting a feeding error;

pressing means for pressing against the stack of sheets when the feeding error is detected by said detection means, thereby urging the stack of sheets against said feeding means;

recording means for recording an operation time of said pressing means; and control means for controlling operation of said pressing means, wherein said control means causes said pressing means to press against the stack when said feeding means operates, without regard to detection of the feeding error, whenever the operation time of the pressing means recorded by said recording means has reached a predetermined time.

14. A device according to claim 13, wherein the feeding error is detected by said detection means when the sheet does not reach a predetermined position after a predetermined time period.

15. A device according to claim 14, wherein said detection means comprises sheet detection sensor for detecting the fed sheet at a predetermined position at a side downstream from the feeding means, and a timer for counting the time from the start of the sheet feeding operation until the sheet reaches said sheet detection sensor.

16. A device according to any of claims 1, 9, 10, and 13, further comprising image reading means for reading the fed sheet.

17. An image forming apparatus having an image forming means and an automatic sheet feeding device, said automatic sheet feeding device comprising:

mounting means for mounting a stack of sheets;

feeding means for feeding each sheet of the stack of sheets from the stack;

pressing means for pressing against the stack of sheets after a start of a sheet feeding operation, thereby urging the stack of sheets against said feeding means;

recording means for recording a number of operations of said pressing means; and control means for controlling operation of said pressing means, wherein said control means causes said pressing means to press against the stack when the sheet feeding operation of the feeding means starts after the number of operations of the pressing means recorded by said recording means has reached a predetermined number.

18. An image forming apparatus having an image forming means and an automatic sheet feeding device, said automatic sheet feeding device comprising:

mounting means for mounting a stack of sheets;

feeding means for feeding each sheet of the stack of sheets from the stack;

pressing means for pressing against the stack of sheets after a start of a sheet feeding operation, thereby urging the stack of sheets against said feeding means;

recording means for recording a number of operations of said pressing means, said recording means recording the number of operations of said pressing means by accumulating operating time of said pressing means; and control means for controlling operation of said pressing means, wherein said control means causes said pressing means to press against the stack when a sheet feeding operation of the feeding means starts after the number of operations of the pressing means recorded by said recording means has reached a predetermined number.

19. An image forming apparatus having an image forming means and an automatic sheet feeding device, said automatic sheet feeding device comprising:

mounting means for mounting a stack of sheets;

feeding means for feeding each sheet of the stack of sheets from the stack;

detection means for detecting a feeding error;

pressing means for pressing against the stack of sheets when the feeding error is detected by said detection means, thereby urging the stack of sheets against said feeding means;

counting means for counting a number of operations of said pressing means; and control means for controlling operation of said pressing means, wherein said control means causes said pressing means to press against the stack when said feeding means operates, without regard to detection of the feeding error, whenever the number of operations of the pressing means counted by said counting means has reached a predetermined number.

20. An image forming apparatus having an image forming means and an automatic sheet feeding device, said automatic sheet feeding device comprising:

mounting means for mounting a stack of sheets;

feeding means for feeding each sheet of the stack of sheets from the stack;

detection means for detecting a feeding error;

pressing means for pressing against the stack of sheets when the feeding error is detected by said detection means, thereby urging the stack of sheets against said feeding means;

recording means for recording an operation time of said pressing means; and control means for controlling operation of said pressing means, wherein said control means causes said pressing means to press against the stack when said feeding means operates, without regard to detection of the feeding error, whenever the operation time of the pressing means recorded by said recording means has reached a predetermined time.

* * * * *

UNITED STATES PATENT AND TRADEMARK OFFICE

CERTIFICATE OF CORRECTION

PATENT NO. : 5,465,949
DATED : November 14, 1995
INVENTOR(S) : TAKESHI YAMADA, ET AL.

It is certified that error appears in the above-indentified patent and that said Letters Patent is hereby corrected as shown below:

Column [56] RC,
line FPD, "5254675 10/1993 Japan" should read --5-254675 10/1993 Japan--.

Column 6,
line 31, "10" should be deleted.

Column 7,
line 33, "sheets; feeding" should read --sheets; ¶ feeding--.

Column 8,
line 34, "fop" should read --for--.

Column 9,
line 29, "comprises" should read --comprises a--.

Signed and Sealed this
Fifth Day of March, 1996

Bruce Lehman

*Attest:*

BRUCE LEHMAN

*Attesting Officer*

*Commissioner of Patents and Trademarks*